US008459702B2

(12) United States Patent
Bourgain et al.

(10) Patent No.: US 8,459,702 B2
(45) Date of Patent: Jun. 11, 2013

(54) CREMONE-BOLT DOOR-LOCKING DEVICE

(75) Inventors: Eric Michel Yves Bourgain, Paris (FR); Christophe Martin, Tremblay en France (FR); Jean-Jacques Masson, Fontenay Sous Bois (FR)

(73) Assignee: Adler S.A.S., Moussy-le-Neuf (FR)

( * ) Notice: Subject to any disclaimer, the term of this patent is extended or adjusted under 35 U.S.C. 154(b) by 356 days.

(21) Appl. No.: 12/426,518

(22) Filed: Apr. 20, 2009

(65) Prior Publication Data

US 2009/0267358 A1 Oct. 29, 2009

(30) Foreign Application Priority Data

Apr. 23, 2008 (FR) ..... 08 52719

(51) Int. Cl.
*E05C 9/00* (2006.01)
*E05C 9/12* (2006.01)
*E05C 1/04* (2006.01)

(52) U.S. Cl.
USPC ..... 292/32; 292/39; 292/42; 49/395

(58) Field of Classification Search
CPC ..... E05B 83/30; E05B 63/0056; E05B 63/04; E05B 47/0012; E05B 9/04; E05C 1/10; E05C 9/041
USPC ..... 292/32, 39, 42, 160, 172, 142, 279; 49/395, 449
See application file for complete search history.

(56) References Cited

U.S. PATENT DOCUMENTS

| | | | | |
|---|---|---|---|---|
| 3,792,885 | A * | 2/1974 | Giardina et al. | 292/39 |
| 3,844,592 | A * | 10/1974 | Giardina et al. | 292/39 |
| 4,058,333 | A * | 11/1977 | Roe et al. | 292/172 |
| 4,921,288 | A * | 5/1990 | Cifuentes et al. | 292/114 |
| 4,932,696 | A * | 6/1990 | White | 292/336.3 |
| 5,437,485 | A * | 8/1995 | Goldschmidt | 292/142 |
| 5,482,334 | A * | 1/1996 | Hotzl | 292/357 |
| 5,561,995 | A | 10/1996 | Copping et al. | |
| 5,810,402 | A * | 9/1998 | Armstrong | 292/39 |
| 6,138,485 | A * | 10/2000 | Fuss et al. | 70/107 |
| 7,025,394 | B1 * | 4/2006 | Hunt | 292/39 |
| 7,523,975 | B2 * | 4/2009 | Chaloupka et al. | 296/37.1 |

FOREIGN PATENT DOCUMENTS

| | | |
|---|---|---|
| EP | 0 615 042 | 9/1994 |
| EP | 0 853 175 | 7/1998 |
| FR | 1 006 291 | 4/1952 |
| NL | 60449 | 8/1947 |

OTHER PUBLICATIONS

EPO Search Report corresponding to French Application No. 0852719.

* cited by examiner

*Primary Examiner* — Thomas Beach
*Assistant Examiner* — Nathan Cumar
(74) *Attorney, Agent, or Firm* — Kilpatrick Townsend & Stockton LLP

(57) ABSTRACT

Cremone-bolt door-locking controlled by rack-and-pinion means. The cremone-bolt rod is connected to a first rack support that is slidably mounted inside a housing that houses a second slidably mounted rack support, each rack support carrying a rack segment in engagement with a pinion, at least one rack segment being hinged to its own rack support and being provided with a set of teeth that is extended over a curved portion of its end.

9 Claims, 3 Drawing Sheets

FIG.4
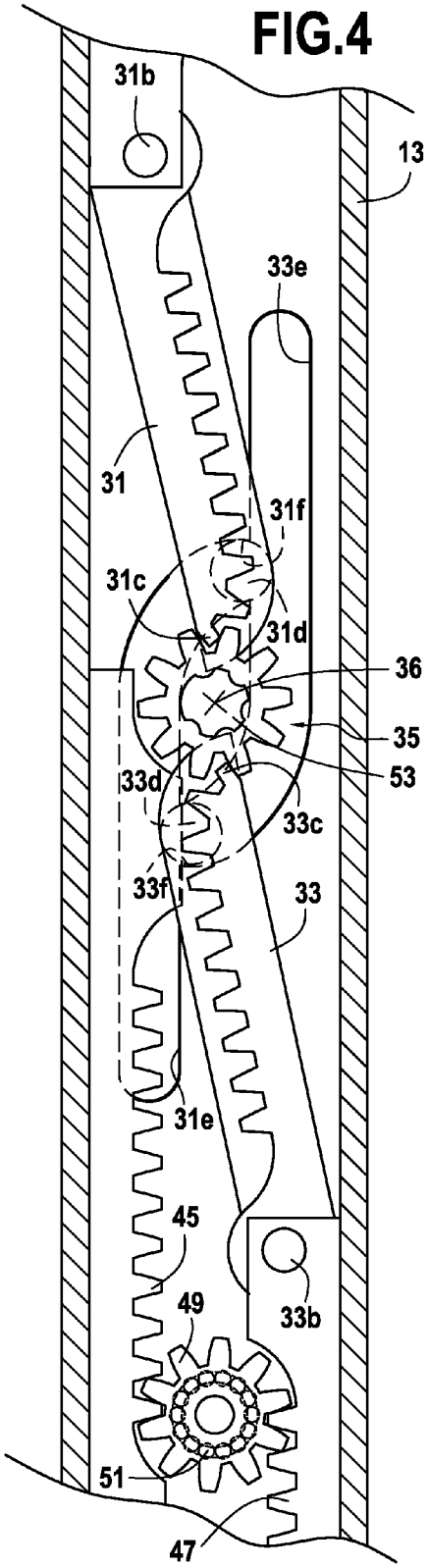
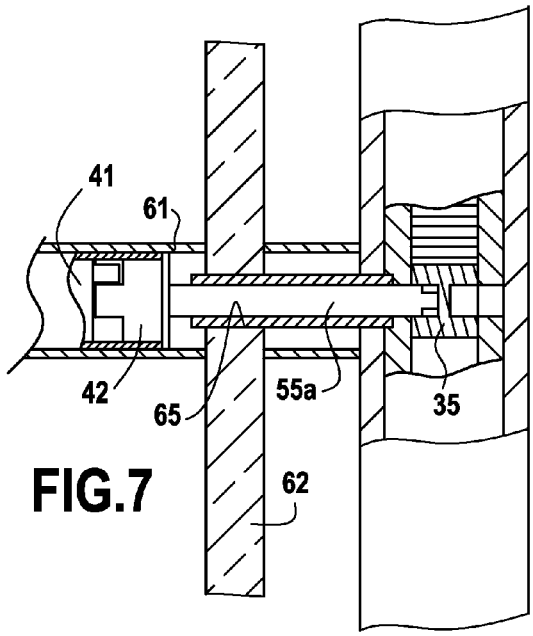
FIG.7
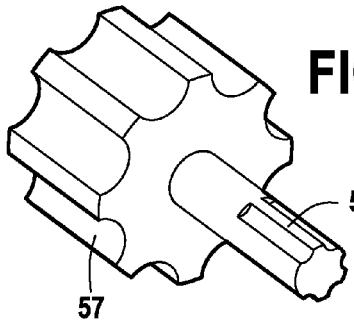
FIG.6
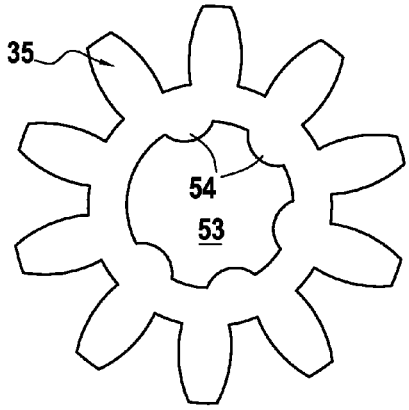
FIG.5

CREMONE-BOLT DOOR-LOCKING DEVICE

This application claims priority to French Application No. 0852719, filed Apr. 23, 2008, the disclosure of the application being incorporated herein by reference in its entirety.

FIELD OF THE INVENTION

The invention relates to a locking device having a cremone-bolt for locking a door, and more particularly to a cremone-bolt door-locking device of the type designed to be installed in a tubular upright fastened along said door and extending to an edge thereof, so that said cremone-bolt can co-operate with a keeper anchored to the wall or to the doorframe. The invention is particularly applicable to closing a glass door provided with such an upright that houses said door-locking device, said upright being installed vertically and held spaced apart from the plane of the door by spacers.

The device of the invention can be actuated by a cylinder-lock rotor, or by two such rotors, or else by a rotor and a knob.

BACKGROUND OF THE INVENTION

In a device of the above-defined type, the action of a key in a rotor or the action of a door knob generates turning movement that needs to be converted into movement in translation of the cremone-bolt rods. Most current systems use locks presenting cylinders that have a so-called "European" profile, also known as "Euro cylinders". In such a system, a tongue or "bit" is turned by the rotor turning in the cylinder. Generally, that turning movement is free over 270° and then, over 45°, the bit pushes a first piston that unlocks a drive fork for driving the cremone-bolt rods. Finally, over the remaining 45°, the bit drives the fork that is secured to the cremone-bolt rods. The cremone-bolt rods are thus actually driven over only one eighth of a turn of a key, thereby giving rise to an unpleasant sensation of a movement that is jerky and sudden, with successive jolts. In addition, such a short working stroke requires at least two turns of a key in order to engage the lock-bolts of the cremone bolt into the keepers to a sufficient depth lying at least in the range 25 millimeters (mm) to 30 mm.

Above all, for such a Euro cylinder, the outer envelope swept by the turning bit is very wide, so that the cylinder can only be received in a tube that is of inside diameter greater than 32 mm.

Finally, that system is always based on an assembly of parts that are quite fragile and that can be damaged rapidly by abnormal stresses.

The invention makes it possible to overcome all of those drawbacks.

OBJECT AND SUMMARY OF THE INVENTION

An object of the invention is to propose a door-locking device that is compact and that can be actuated over the entire stroke of a rotor or of a knob.

More particularly, the invention provides a cremone-bolt door-locking device comprising at least one cremone-bolt rod projecting from one end of an elongate housing, wherein:

- said cremone-bolt rod is connected to a first rack support that is slidably mounted inside the housing;
- said housing houses a second rack support slidably mounted inside said housing and installed facing the first support rack;

- each rack support carries a rack segment provided with a set of teeth in engagement with a pinion installed between the two rack segments;
- at least one rack segment is hinged to its own rack support; and
- the set of teeth of said hinged rack segment is extended over a curved portion of a free end of said segment so as to enable said hinged rack segment to pivot at the end of the stroke and to be braced, thereby making movement of said cremone-bolt rod irreversible.

Thus, since actuation is distributed over the entire stroke of the rotor of the lock and not merely over one eighth of its stroke, it requires only one turn of the key.

In addition, the force to be exerted on the key during this single turn of the key is relatively constant.

Preferably, each rack support carries a hinged rack segment whose set of teeth is extended over a curved portion of its free end, the pivot axes of the two segments being parallel to the axis of said pinion and extending symmetrically about said axis of said pinion.

Advantageously, said pinion is an actuator pinion connected to rotary control means, such as, for example, the rotor of a cylinder lock or merely a knob.

Said control means can comprise a security rotor that is cylindrical but that is driven axially, thereby making it possible to reduce the diameter of the tube forming the housing of said cylinder. Said tube usually constitutes a spacer for a cylindrical upright fastened to the door and forming a handle therefor.

Control can be performed by a rod of relatively small diameter. The orifice formed in the door is thus of diameter much smaller than a bit-bearing rotor of the "European profile" or "Euro cylinder" type.

Preferably, said second rack support is connected to a second cremone-bolt rod projecting from the opposite end of said elongate housing. It is thus easily possible to implement dual locking, both upward and downward.

The housing may be substantially cylindrical, and of small diameter, thereby making it easy to incorporate into a stationary tubular upright installed along the door, usually vertically.

In an advantageous embodiment, each rack support carries another rack segment provided with a set of teeth in engagement with a freely rotatable pinion that is free to rotate about a pin that is stationary relative to the housing, which pinion is mounted between said other rack segments and meshes therewith.

Thus, this second pinion that is free to rotate but whose pin is supported by bearings, ideally ball bearings, serves to hold the overall assembly in space and to balance the masses of the top and bottom cremone-bolt rods and lock-bolts. The first above-mentioned pinion is used for driving the overall assembly and does not bear any vertical force. It is not secured vertically, but rather it is merely supported in stress-free manner by the racks that it actuates.

However, it is possible to imagine omitting said second pinion and said other rack segments by providing support bearings or ball bearings between the actuator pinion and the housing, if enough space is available inside the housing.

The invention can be better understood and other advantages of the invention appear more clearly on reading the following description of a currently preferred embodiment of a cremone-bolt door-locking device complying with the principle of the invention, and given merely by way of example and with reference to the accompanying drawings, in which:

BRIEF DESCRIPTION OF THE DRAWINGS

FIG. 4 is a fragmentary detail view on a larger scale, showing the device in the FIG. 3 state;

FIG. 5 is a detail view of the drive pinion of the device;

FIG. 6 is a perspective view of an actuator knob; and

FIG. 7 is a diagrammatic view showing how the device is mounted on a door, with the lock on the outside.

MORE DETAILED DESCRIPTION

Figure 1:
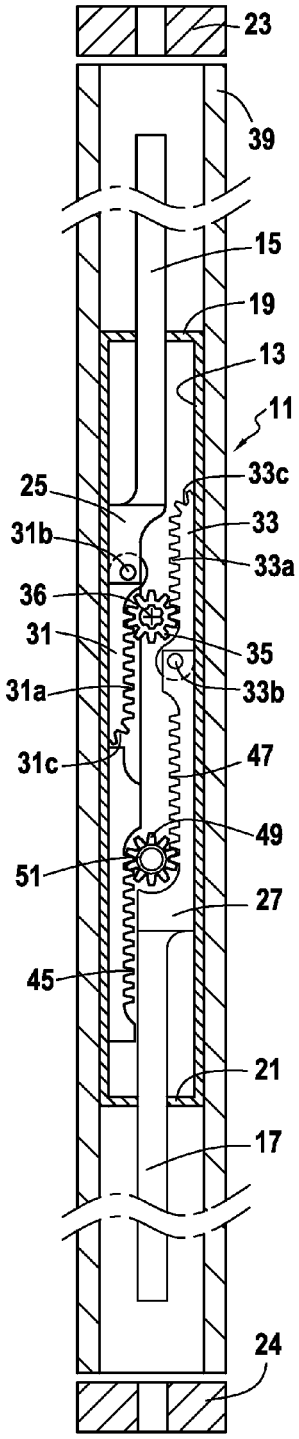
FIGS. 1, 2 and 3 are section views of a cremone-bolt door-locking device of the invention/ shown in different states/ for the purpose of illustrating how it operates.

The drawings show a door-locking device 11 having a cremone bolt and arranged inside an elongate housing 13 that is substantially cylindrical in this example. The housing could also be rectangular block shaped. The device includes at least one cremone-bolt rod that projects from one end of the housing 13. In the example shown in FIGS. 1, 2 and 3, and advantageously, the device includes two cremone-bolt rods 15, 17 that project from respective ones of the two opposite ends 19, 21 of the cylindrical housing 13, whereas the example shown in FIGS. 1A, 2A and 3A only include a single cremone-bolt rod 17. Each rod 15, 17 forms a lock-bolt at its free end and said lock-bolt co-operates with a respective keeper 23, 24 anchored to the wall or to the doorframe/ in the vicinities of the top and bottom edges of the door in this example.

The cremone-bolt rod 15 that projects from the end 19 of the housing is connected to a first rack support 25 that is slidably mounted inside the housing 13.

The housing houses a second rack support 27. Said second rack support is slidably mounted inside the housing and is installed facing the first support rack.

The two rack supports slide without meeting each other and in mutually opposite directions.

In the example, the second rack support 27 is connected to the second cremone-bolt rod 17 that projects from the end 21 of the housing.

Each rack support 25, 27 carries a rack segment 31, 33 that is hinged to said support and that is provided with a set of teeth 31*a*, 33*a* in engagement with a pinion 35 installed between the two rack segments. The hinge pins 31*b*, 33*b* of the two rack segments are parallel to the axis 36 of the pinion 35 and extend symmetrically about that axis.

The set of teeth of at least one rack segment, and advantageously the set of teeth of each rack segment is extended over a curved portion 31*c*, 33*c* of a free end of said segment 31, 33 so as to enable the two rack segments to pivot at the end of their strokes and to be braced on either side of said pinion. In other words, the free end of the rack segment or of each rack segment is provided with gear teeth. It is this end-of stroke movement shown in FIG. 3 that guarantees that the movement of the or of each cremone-bolt rod 15, 17 is irreversible.

Figure 2:
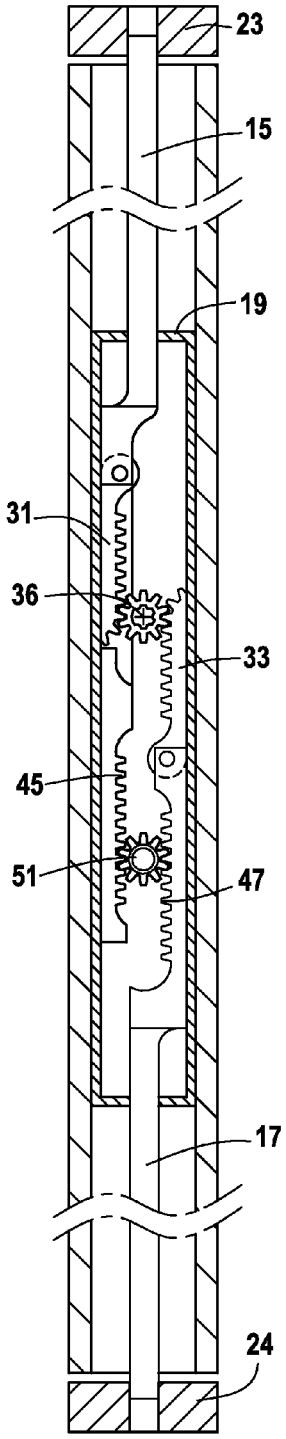
Figure 3:
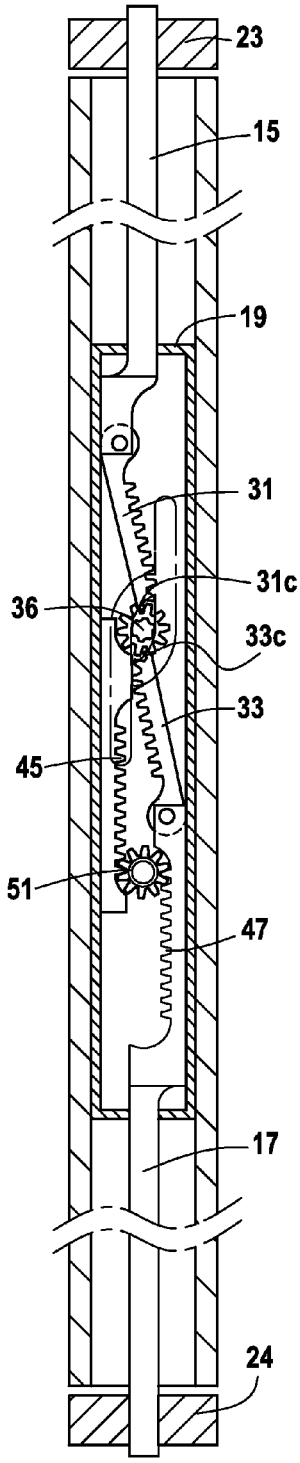
Figure 1A:
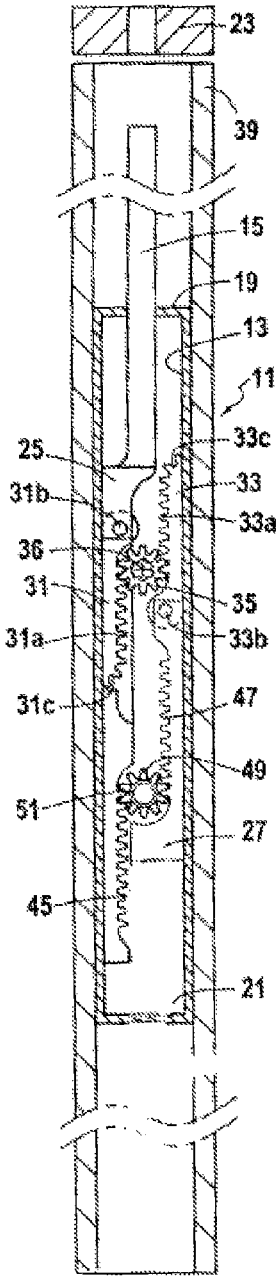
FIGS. 1A, 2A and 3A are section views of a cremone-bolt door-locking device of the invention/shown with one bolt.
Figure 2A:
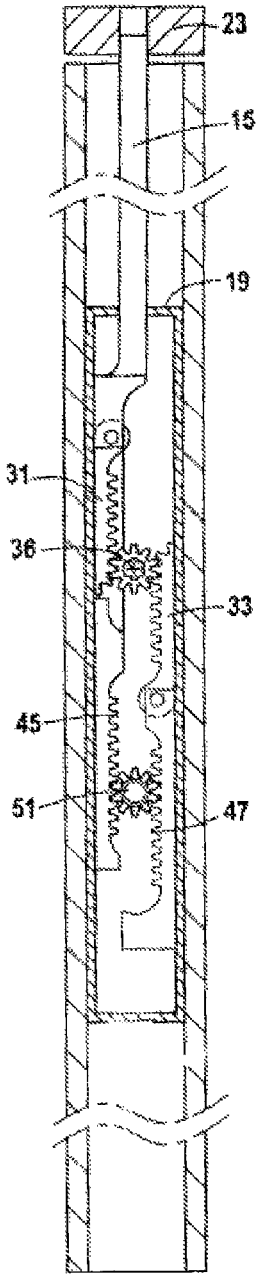
Figure 3A:
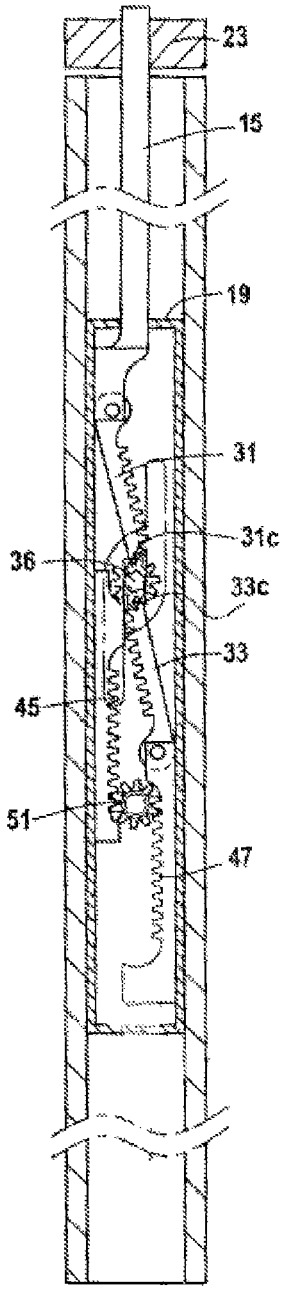

In the example described, the pinion 35 is an actuator pinion connected to rotary control means. The term "rotary control means" is used to mean any mechanical element or subassembly that is suitable for being coupled to the pin of the pinion for the purpose of driving said pinion in rotation. Such an element or subassembly can comprise merely an actuator knob (FIG. 6) extended by a rod coming to be coupled axially to the pinion, or else an axially driven cylindrical security lock rotor (FIG. 7) that is actuated by a key and that is itself extend by a rod. The device as described in FIGS. 1 to 3 is advantageously placed inside a tube 39 that forms a handle, that is mounted via spacers along a door, and that typically extends from top to bottom of the door. A hole, provided in the housing 13 and facing the pin of the pinion 35 makes it possible to pass a rod that is part of said rotary control means. Advantageously, the housing is provided with two mutually aligned holes on either side of the actuator pinion in such a manner as to enable both an inside actuator element and an outside actuator element to be coupled.

The tube 39 containing the door-locking device is preferably placed on the inside. The rotary control means (FIG. 7) can be engaged in a spacer connecting the tube to the door.

As can be seen in FIG. 4, each rack segment 31, 33 is provided with a lug 31*d*, 33*d* mounted to slide in a corresponding groove 31*e*, 33*e*. Said groove is formed in the inside wall of the housing 13. The shape of the groove defines the path along which the lug travels while the rack segment is moving and is pivoting at the end of its stroke. Thus, in the locking position, the lug coming into abutment against the wall of the curved end portion 31*f*, 33*f* of the corresponding groove that extends transversely to the path of the rack support makes it possible to ensure that any forces exerted on the rods 15, 17 axially in directions tending to urge them into the housing are prevented from being exerted on the pinion, thereby avoiding the risk of them causing excessive stresses to be exerted in the sets of teeth of the pinion and of the racks, or indeed of them ovalizing the pinion. In other words, the irreversibility of the mechanism is guaranteed essentially by the lugs 31*d*, 33*d* coming into abutment against the walls of the curved end portions of the corresponding grooves 31*e*, 33*e*.

In addition, each rack support 25, 27 carries another rack segment 45, 47 that is non-hinged, that is provided with a set of teeth in engagement with a pinion 49 that is mounted to be free to rotate and that has a pin that is stationary relative to the housing. This pinion is mounted between the two other rack segments 45, 47 and meshes with them. The freely rotatable pinion 49 is supported by bearings that are secured to or integral with the housing. Advantageously, said bearings are constituted by ball bearings 51 or the like.

As shown in FIG. 5, the central portion of the actuator pinion 35 is hollow so as to receive the end of an actuator rod. The hollow portion is in the form of a multi-lobe coupling cavity 53. The shape of this cavity, with lobes 54 projecting circumferentially into said cavity 53, is known to enable high torque to be transmitted. The cavity is thus adapted to receive the end of an actuator rod 55 of complementary shape that is integral with or coupled to an operating member. For example, FIG. 6 shows an operating knob 57 (that can, in particular, be used for operating the device from inside premises). Said button 57 is extended by a rod 55 whose end has a shape complementary to the shape of the cavity so that it can be engaged axially therein.

One of the lobes 54 of the cavity is omitted in order to index the system. In this way, the device can be actuated by a security rotor 41 that is cylindrical in this example, and that is key-operated, the movement of the rotor and the movement of the cremone-bar door-locking device being drivingly "synchronized" by this type of simple indexing.

The rotor can have some other shape. The invention is compatible with a cylinder having a "European" profile or "Euro cylinder".

FIG. 7 diagrammatically shows how the rotor 41 is mounted in a tube 61 that is mounted perpendicularly to the door 62 along the axis of the actuator pinion 35. The bit of this type of rotor is situated at the end thereof, it turns in the housing of the rotor, and it is provided with a recess into which a head 42 (of complementary shape) engages, which head is extended by a rod 55*a* similar to the rod of the button 57 of FIG. 6 and has an end that engages in the cavity 53 of the actuator pinion. Since the diameter of the rod is small, the diameter of the hole 65 formed in the door 62 is also small.

Operation can be understood clearly from the above description. In the situation of FIG. 1, the door is in the shut but not locked situation. The cremone-bolt rods 15, 17 are facing the keepers 23, 24 but are not engaged therein.

In the FIG. 2 situation, the rotary control means have been operated so as to cause the two rack supports 25, 27 to move in opposite directions, by meshing between the pinion 35 and the hinged rack segments 31, 33. This first portion of actuation of the device results in the rods being engaged into the respective keepers without the rack segments 31, 33 pivoting. The locking is effective but is still reversible because, if an inward axial force is exerted on either of the rods 15, 17 said rods are caused to retract, and therefore the door is re-opened.

However, as shown in FIG. 3, because the set of teeth on each rack segment 31, 33 is extended over a curved portion of a free end of said segment, the locking device coming to the end of its actuating stroke causes the two rack segments to pivot and to be braced on either side of the pinion 35. As mentioned above, in this situation, any axial forces that might be exerted on the rods are in fact taken up by the lugs 31*d*, 33*d* coming into abutment against the walls of the curved end portions of the corresponding grooves 31*e*, 33*e*. The hollow pinion 35 is thus not subjected to any stress tending to flatten it between the ends of the two rack segments.

What is claimed is:

1. A cremone-bolt door-locking device comprising a pair of rods, one of the rods projecting from one end of an elongate housing and the other of the rods extending from the other end of the housing, wherein:

one of said rods is connected to a first rack support that is slidably mounted inside the housing;

said housing houses a second rack support connected to the other rod, said second rack support slidably mounted inside said housing and installed facing the first support rack;

each rack support carries a respective rack segment provided with a set of teeth in engagement with an actuator pinion installed between the two rack segments, said actuator pinion being connected to a rotary control mechanism;

each rack segment is hinged to the rack support that carries it; and the set of teeth of each hinged rack segment is extended over a curved portion of a free end of said segment so as to enable each hinged rack segment to pivot at the end of the stroke and to be braced, thereby making movement of the rods irreversible until the actuator pinion is reversely rotated.

2. A device according to claim 1, wherein each rack support carries a hinged rack segment whose set of teeth is extended over a curved portion of a free end, the pivot axes of the two segments being parallel to the axis of said pinion and extending symmetrically about said axis of said pinion.

3. A device according to claim 1, wherein said housing is substantially cylindrical.

4. A device according to claim 3, wherein each rack segment is provided with a lug mounted to slide in a corresponding groove formed in the inside wall of said housing, the shape of the groove defining the path along which said lug travels while the rack segment is moving, so that, in the locking position, the irreversibility is guaranteed essentially by the lug coming into abutment against the wall of a curved end portion of the corresponding groove that extends transversely to the path of said rack support.

5. A device according to claim 1, wherein each rack support carries another rack segment provided with a set of teeth in engagement with a freely rotatable pinion that is free to rotate about a pin that is stationary relative to the housing, which pinion is mounted between said other rack segments and meshes therewith.

6. A device according to claim 5, wherein the pin of said freely rotatable pinion is supported by bearings that are integral with or secured to the housing.

7. A device according to claim 6, wherein said bearings are constituted by ball bearings.

8. A device according to claim 7, wherein the central portion of said actuator pinion is provided with a multi-lobe coupling cavity adapted to receive the end of an actuator rod of complementary shape that is integral with or coupled to an operating member.

9. A cremone bolt door locking device comprising a cremone bolt rod projecting from an end of an elongate housing, wherein:

said cremone bolt rod is connected to a first rack support that is slidably mounted inside the housing;

said housing houses a second rack support slidably mounted inside said housing and installed facing the first support rack;

each rack support carries a respective rack segment provided with a set of teeth in engagement with an actuator pinion installed between the two rack segments, said actuator pinion being connected to a rotary control mechanism;

each rack segment is hinged to the rack support that carries it;

the set of teeth of each hinged segment is extended over a curved portion of a free end of said segment so as to enable each hinged rack segment to pivot at the end of the stroke and to be braced, thereby making movement of said cremone bolt rod irreversible until the actuator pinion is reversely rotated; and each rack support carries another rack segment provided with a set of teeth in engagement with a freely rotatable pinion that is free to rotate about a pin that is stationary relative to the housing, which freely rotatable pinion is mounted between said other rack segments and meshes therewith.

* * * * *